United States Patent [19]

DuFort

[11] Patent Number: 4,825,216

[45] Date of Patent: Apr. 25, 1989

[54] HIGH EFFICIENCY OPTICAL LIMITED SCAN ANTENNA

[75] Inventor: Edward C. DuFort, Fullerton, Calif.

[73] Assignee: Hughes Aircraft Company, Los Angeles, Calif.

[21] Appl. No.: 805,068

[22] Filed: Dec. 4, 1985

[51] Int. Cl.[4] ..... H01Q 3/00

[52] U.S. Cl. ..... 342/376; 342/372; 343/754

[58] Field of Search ..... 343/754, 911 L, 753; 342/376, 374, 372, 373

[56] References Cited

U.S. PATENT DOCUMENTS

| | | | |
|---|---|---|---|
| 3,835,469 | 9/1974 | Chen et al. | 343/754 |
| 3,979,754 | 9/1976 | Archer | 343/754 |
| 3,984,840 | 10/1976 | Dell-Imagine | 343/754 |
| 4,028,702 | 6/1977 | Levine | 342/374 |
| 4,085,404 | 4/1978 | Gallant | 343/754 |
| 4,114,162 | 9/1978 | Wild | 343/753 |
| 4,146,895 | 3/1979 | Wild | 343/754 |
| 4,194,209 | 3/1980 | Coulbourn, Jr. | 343/753 |
| 4,222,054 | 9/1980 | Capps | 343/754 |
| 4,246,585 | 1/1981 | Mailloux | 343/854 |
| 4,254,421 | 3/1981 | Kreutel, Jr. | 343/754 |
| 4,268,831 | 5/1981 | Valentino et al. | 343/754 |
| 4,288,795 | 9/1981 | Shelton | 343/754 |
| 4,306,238 | 12/1981 | Enein | 342/408 |
| 4,321,604 | 3/1982 | Ajioka | 343/753 |
| 4,381,509 | 4/1983 | Rotman et al. | 343/754 |
| 4,458,249 | 7/1984 | Valentino et al. | 343/754 |
| 4,472,719 | 2/1984 | Hills | 343/18 E |
| 4,488,156 | 12/1984 | DuFort et al. | 343/754 |
| 4,489,325 | 12/1984 | Bauck et al. | 342/374 |
| 4,491,845 | 1/1985 | Rothenberg | 343/754 |
| 4,507,662 | 3/1985 | Rothenberg et al. | 342/376 |
| 4,509,055 | 4/1985 | Fassett | 343/754 |

FOREIGN PATENT DOCUMENTS

| | | |
|---|---|---|
| 2352411 | 12/1977 | France . |
| 2441930 | 6/1980 | France . |

OTHER PUBLICATIONS

"Optimum Optical Limited Scan Antenna", Pg. 1133–1142, IEEE Transactions on Antennas and Propagation, Sep. 1986, #9.

International Search Report, PCT Application No. PCT/US 86/02590 (PD-84097P).

*Primary Examiner*—Stephen C. Buczinski

*Assistant Examiner*—John B. Sotomayor

*Attorney, Agent, or Firm*—T. A. Runk; A. W. Karambelas

[57] ABSTRACT

An optical limited scan antenna system is disclosed. The invention is a dual lens type array antenna system with a small array feed network. The system includes a bootlace-type microwave aperture lens with an array of radiating elements arranged along the linear aperture and an array of pickup elements arranged along the curved inner surface, an intermediate optical corrective lens, a feed array for illuminating the corrective lens with a source distribution, and with a power divider and phase shifters arranged to drive the feed array. The corrective lens is circularly symmetric (spherically symmetric in the three-dimensional case), and its radially varying dielectric constant is such that a point source on its surface is focused to an image point on the inner surface. The pickup elements on the curved surface of the aperture lens are coupled to corresponding radiating elements on the linear aperture. The corrective and aperture lens cooperate to map an input or source distribution into an aperture distribution which is a scaled version of the source distribution. The system results in high efficiency obtained with a minimum number of active elements and relatively low cost optical components.

21 Claims, 5 Drawing Sheets

FIG. 1
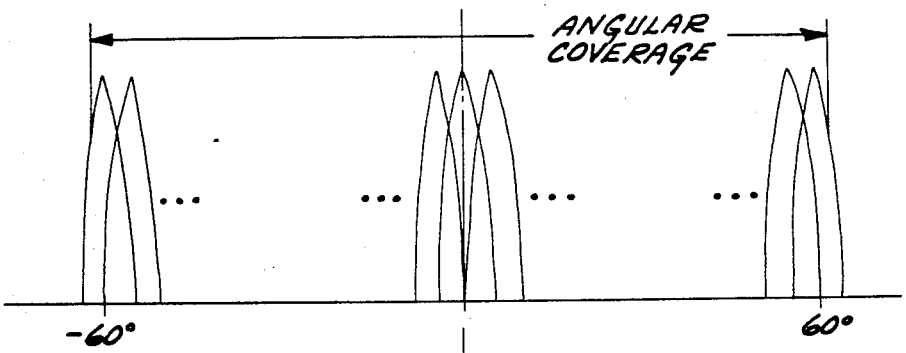
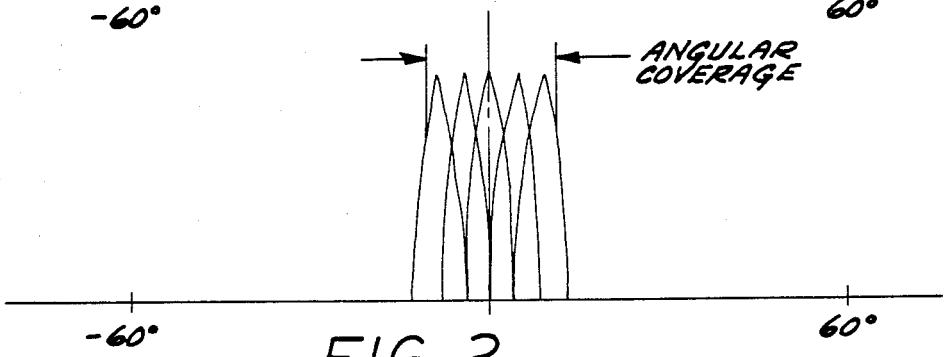
FIG. 2
FIG. 3
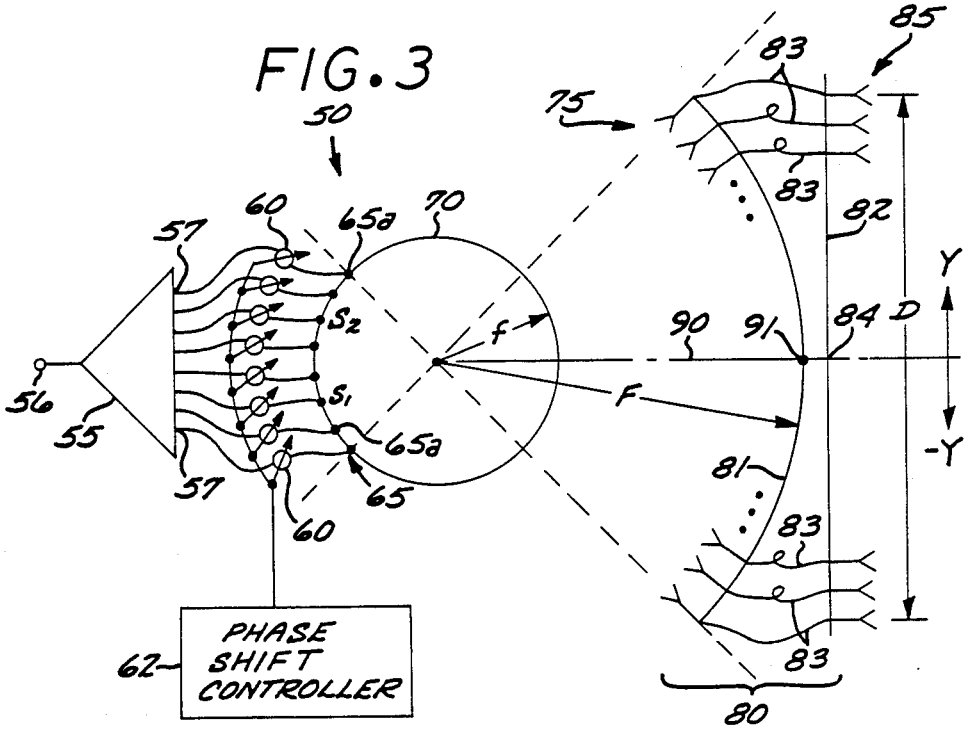

HIGH EFFICIENCY OPTICAL LIMITED SCAN ANTENNA

BACKGROUND OF THE INVENTION

The present invention relates to limited scan antennas, and more particularly to a high efficiency, relatively low cost antenna for scanning a narrow beam over a specified angular section with maximum possible gain consistent with the aperture size while using the minimum number of active elements.

The conventional phased array with one phase shifter per element scans a narrow beam many beamwidths within a sector of perhaps ±60° from broadside. The angular coverage of such a wide angle scan antenna is illustrated in FIG. 1. A limited scan antenna scans a narrow beam only a few beamwidths about some nominal position, often broadside. The angular coverage of such a limited scan antenna is depicted in FIG. 2. Limited scan systems find use in several applications including:

(i) Weapon locator radars;
(ii) Microwave landing systems;
(iii) Satellite communication systems; and
(iv) Adaptive antennas.

In the first application, accurate trajectory measurements are required early in the flight of a projectile in order to ascertain the source. Narrow high gain beams are required to combat noise and minimize multipath effects, but only a few beamwidths of scan are necessary. The same considerations apply to blind landing systems. The third application requires a narrow high gain beam emanating from a satellite and covering only a portion of the earth—perhaps half a continent. The total number of such beams required to cover the earth is moderately small and the viewing angle of the earth from a satellite in geosynchronous orbit is only 18°. Communication may be accomplished with immunity from interference arising outside a single beam coverage.

A more recent application of limited scan antennas is for use in adaptive arrays. The active modules in such an antenna may be phase shifters and attenuators which are set by control circuitry designed to minimize interference at the output in the receive mode. The terminals attached to the active elements each produce subarray distribution in the aperture. The subarray distributions are virtually identical for each terminal. The corresponding patterns provide the highest possible gain and largest grating lobe suppression possible within the desired limited field of view. This provides greater signal-to-noise and virtually no spurious grating lobe responses. In addition, since the subarrays are all alike, very fast adaptive algorithms such as the Maximum Entropy Method may be employed.

Limited scan antenna designs attempt to provide the same gain and sidelobe performance as a complete phased array with the same aperture. Because only a few beamwidths of scan are required it seems reasonable to expect that it should not be necessary to provide one phase shifter per aperture element to perform the limited scan function. Since the phase shifters and phase shifter drivers are typically the most expensive items in a phased array and these units also are the principal contributors to availability reliability indices of antenna performance, the objective of a limited scan antenna design is to minimize the number of active components without incurring an inordinate growth in the complexity of the passive equipment or a degradation in gain and sidelobe performance. However, the latest technological trend is to distribute solid state transmit amplifiers, receive preamps, phase shifters, and like active devices through the array.

Limited scan capability can be provided using constrained circuitry, i.e., circuitry wherein the rf energy is confined by transmission lines. A standard for comparison is a system comprising a large Butler matrix fed by a small Butler matrix. Such a system is described, for example, in "A Multiple-beam Antenna Feed Network," C. Rothenberg and S. Milazzo, Radiation Division, perry Gyroscope Co., June, 1965. Butler matrices are well known in the art and are described, for example, in the paper "An Electrically Scanned Beacon Antenna," A. E. Holley, E. C. DuFort and R. A. Dell-Imaguire, IEEE Trans. AP-22, Jan., 1974, page 3. The large Butler matrix is a network which produces simultaneous high gain beams but only a few are used for limited scan. The small Butler matrix, in conjunction with the phase shifters and uniform power divider, slides the terminal weighting of the large Butler matrix to steer the beam. This system is optimal in that the fewest number of active elements (equal to the number of beamwidths of scan) is used, the gain is maximized and the levels of the grating lobes are low. However, it is a totally constrained system which is impractical in many cases where even the small Butler matrix is too large, heavy and expensive.

In a survey article, Mailloux reviewed a hybrid scheme utilizing a bootlace aperture lens and a Butler matrix. R. J. Mailloux, "Phased Array Theory and Technology," *Proc. IEEE* 70, No. 3, March 1982, page 246 et. seq. Although performance of such a scheme is better than the purely optical approaches available at that time the Butler matrix may be too large for practical application—especially for three dimensional cases.

Researchers have sought the optical equivalent of the Butler/Butler limited scan technique. U.S. Pat. No. 3,835,469, of which the present applicant is a co-inventor, discloses a lens type optical scheme which has low phase error. The illumination of the aperture by the small array and correction lens does not stay fixed as the beam is scanned. There is spillover loss on one side and underillumination on the other. This problem can be corrected only by using more than the minimum number of elements.

A second purely optical approach is described in the report by C. H. Tang and C. F. Winter, "A Study of the Use of a Phased Array to Achieve Pencil Beams Over a Limited Sector Scan," AFCRL TR-7300482, ER-73-4292, Raytheon Company, Final Report Contract F19628072-C-0213, AD 768 618. With this approach, a corrective bootlace lens is placed in the focal region. The feed array is focused to a point on the corrective lens and the focal distribution is mapped onto the aperture side of the lens. This focal distribution in turn illuminates the aperture. The beam is scanned in the far field by moving the focal point along the feed side of the corrective lens using the feed array phase shifters. Although the system is geometrically focused for all scan angles, the aperture illumination slides off to one side as the beam scans, resulting in spillover at one end and under-illumination at the other end of the aperture. The system is very efficient up to half the maximum scan angle if the corrective lens radii are optimized empirically; however, gain is still much lower than the Butler matrix technique at maximum scan. The only apparent remaining ways to improve the approach is to use about twice the theoretical minimum number of elements or use a large under-illuminated aperture.

It would therefore represent an advance in the art to provide an optical limited scan antenna which employs the smallest possible aperture and the minimum number of active elements while maintaining nearly 100% efficiency for all angles within the limited field of view.

SUMMARY OF THE INVENTION

The invention comprises a dual lens type array antenna with a subarray feed network. The antenna system comprises radiating and pick-up elements, a bootlace-type microwave aperture lens, an intermediate optical lens fed by a feed array, phase shifters, and an input power divider. In accordance with the invention, the number of phase shifters is much less than the number of radiating elements. The only active elements in the system are the phase shifters, of which only a relatively small number are required; all other components are passive.

The intermediate optical lens is circularly symmetric with radius f in the two-dimensional case, and spherically symmetric in the three dimensional case. The radially varying dielectric constant of this optical lens is such that a point on its surface is focused to a point at a distance F on the circular back side of the aperture lens. The feed point, center of the lens, and focal point are colinear as a consequence of symmetry.

The aperture lens is a bootlace type whose inner surface is circular (in the two-dimensional case), and is centered on the center point of the intermediate lens. The pick-up elements on the back side of the aperture lens are connected with equal lengths of transmission line to radiating elements on the linear aperture. The spacing of elements on the two surfaces may be the same, or they may vary in accordance with the Abbe sine condition where the spacing on one side is non-uniform. The aperture lens has only one perfect focus at the center of the intermediate lens.

The preferred embodiment is entirely optical, of the feed-through type containing only lenses (not reflectors). There are no coupler/transmission line matrices, Butler matrices, or other constrained networks required other than the input power divider, but an optical radial power divider may perform that function as well. There are no switches or other active elements required except the phase shifters and these are far fewer than the number of aperture elements.

The number of phase shifters required is equal to the number of beamwidths of scan desired. The system uses the entire aperture for all scan angles with negligible spillover loss and is nearly 100% efficient, with virtually no loss and nearly maximum possible gain corresponding to the aperture size.

BRIEF DESCRIPTION OF THE DRAWINGS

These and other features and advantages of the present invention will become more apparent from the following detailed description of an exemplary embodiment thereof, as illustrated in the accompanying drawings, in which:

FIGS. 1 and 2 depict the respective angular coverages of wide angle scan antennas and limited scan antenna systems.

FIG. 3 is a schematic representation of the major components of the disclosed embodiment of the invention.

DETAILED DESCRIPTION OF THE DISCLOSURE

Figure 4:
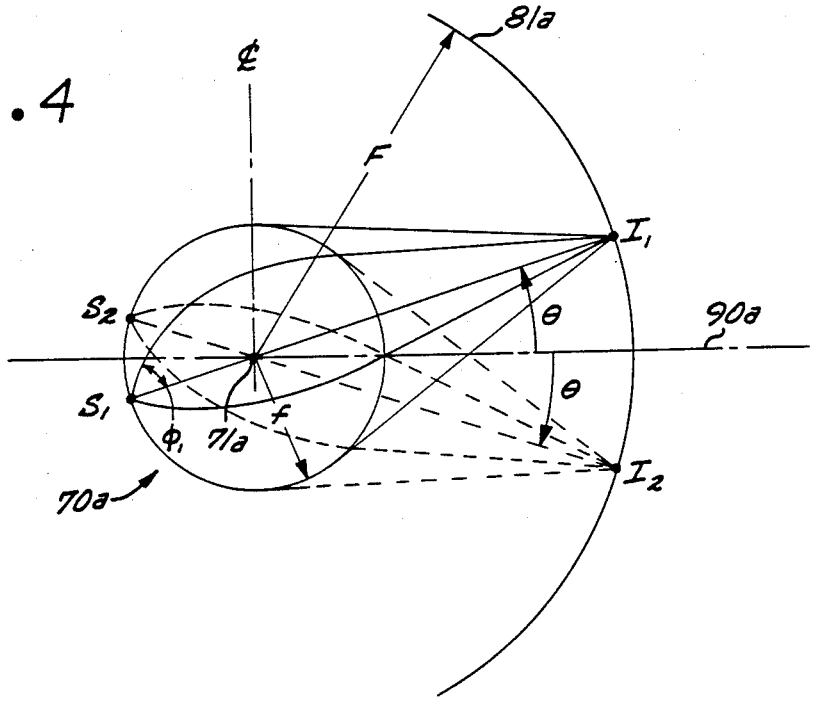
FIG. 4 is a schematic ray diagram illustrating the interrelation of the intermediate corrective lens employed in the disclosed embodiment.

Referring now to FIG. 3, a schematic representation of the major components of a limited scan antenna system 50 employing the invention is disclosed. The system 50 comprises a power divider 55 having an input port 56 and a plurality of output ports 57, a plurality of phase shifters 60, a feed array 65 comprising a plurality of individual feed elements 65*a*, an intermediate optical lens 70, pickup elements 75, bootlace lens 80, and radiating elements 85.

The operation of the invention and the selection of the system parameters can be discussed in terms of geometrical optics. A circular corrective lens 70*a* having a radius f and whose dielectric constant depends only on the radial distance is shown in FIG. 4. In accordance with the invention, the dielectric constant distribution is chosen so that rays from a point source $S_i$ at the lens surface are bent by the lens 70*a* and focused to another point $I_i$ at a distance $F \geqq f$. From symmetry, the source $S_i$, center 71*a* of the lens 70*a*, and the focal point $I_i$ will be colinear. Also from symmetry, if the above focal condition is true for one pair of points $S_i$ and $I_i$, then all points on the circular lens surface will image to unique focused points on the image surface $\mathbf{81}_a$ at the radius F. This lens 70*a* will uniquely image the circular source distribution onto the circular image surface 81*a*, and when measured in terms of the azimuthal angle $\theta$ about the center 71*a* of the lens 70*a*, the image distribution will correspond to the source distribution at the surface of the corrective lens 70*a* because the path length for all pairs of points is the same. In terms of arc length measured respectively along the image circle and the surface 81*a* from the line of symmetry, the image distribution on surface 81*a* will be a stretched replica of the source distribution on the surface of lens 70*a*.

In accordance with the invention, the image circle on the back surface 81 of the aperture bootlace lens 80 shown in FIG. 3 is mapped onto the linear aperture 82 without distortion by means of equal lengths of transmission lines 83 connecting all point pairs whose arc lengths measured from the line of symmetry 90 are the same. That is, a point on surface 81 having an arc length L measured from point 91 (at the intersection of the surface 81 and the line of symmetry 90) will be connected to a point on linear aperture 82 which is the same distance L measured from point 84 (at the intersection of the linear aperture 82 and the line of symmetry 90). This simply straightens out the image distribution. Thus, it is seen that the source function $A_1(s_1)e^{j\psi_1(s_1)}$, where $s_1$ is the arc length measured from the intersection of the line of symmetry 90 with the feed surface of the corrective lens 70 to the feed point s (FIG. 3), becomes an aperture distribution $A_1(y)\,e^{-j\psi_2(y)}$ where y is the linear distance along the linear aperture measured from the aperture center 90, and the relative phases of the respective aperture and source distributions at corresponding points y and s, where $y=Fs_1/f$, are the same $$\psi_2(y)=\psi_1(s_1)=\psi_1(fy/F) \tag{1}$$

and the amplitudes differ by a constant scale factor determined from conservation of energy:

$$A_1^2(s_1)ds_1=A_2^2(y)dy \tag{2}$$

where $ds_1$ and dy represent differential arc lengths. Since $dy/ds_1=F/f$, Eq. 2 becomes $$A_2(y)=(f/F)^{\frac{1}{2}}A_1(fy/F). \tag{3}$$

Figure 5:
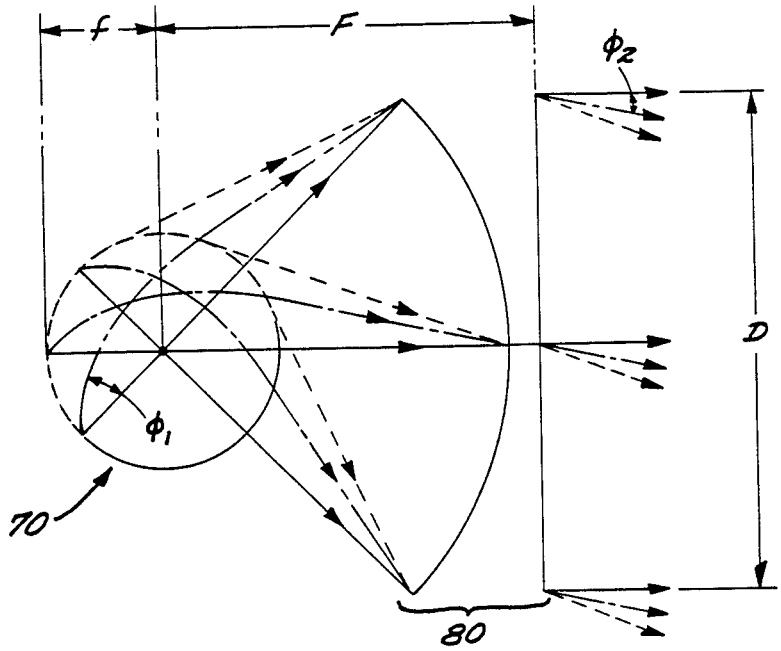
FIG. 5 is a schematic ray diagram illustrating the operation of the bootlace lens and the intermediate optical lens employed in the preferred embodiment at respective broadside, intermediate, and the maximum scan angles.

Therefore, a source or input distribution with a constant amplitude produces the constant amplitude aperture distribution necessary for maximum efficiency. In particular, let the input phase distribution $\psi(s_1)$ be linear as a function of the arc length $s_1$, $$\psi_1=ks_1\sin\phi_1, \tag{4}$$

where k is the wave number $2\pi/\lambda$, and where $\phi_1$ is the angle at which rays depart from the feed array 65 at the surface of the intermediate lens (FIG. 5).

Then the aperture distribution has constant amplitude and a phase distribution given by $$\psi_2(y) = \frac{kfy}{F}\sin\phi_1 \tag{5}$$

Rays which leave the feed array 65 at constant angle $\phi_1$ would then leave the aperture 82 at angle $\phi_2$ obtained from Eq. 5, $$\sin\phi_2 = \frac{f}{F}\sin\phi_1 \tag{6}$$

and the aperture array is perfectly focused to infinity at the angle $\phi_2$. By using a feed array distribution having a constant amplitude, the amplitude of the resulting aperture distribution will also be constant (from Eq. 3), there is neither spillover nor phase distortion, and 100% aperture efficiency is obtained. The angular scan in the far field is, however, limited because $\sin^2\phi_1<1$; consequently from Eq. 6, $$\sin^2\phi_2<(f/F)^2. \tag{7}$$

In a preferred embodiment employing a constant amplitude feed array distribution, the bootlace aperture lens 80 is not the usual Abbé lens for which pairs of points at the same distance y on the respective image circle 81 and linear aperture 82 are connected. Instead, pairs of points equidistant from the line of symmetry 90 measured along the respective image circle 81 and along the linear aperture 82 are connected together. This lens 80 does not focus to a point on receive as the Abbé lens does. On receive, all incoming rays strike the aperture 82 at the same angle of incidence; therefore, this angle is preserved for all rays in the lens 80 and the rays focus to a point only at normal incidence.

The maximum scan angle noted above, as well as the choice of usable ratios of the dimensions F and D (F/D), are established by noting that at the maximum scan angle all incoming rays are tangent to the corrective lens 70. Further increases in the incoming angle cause the rays to miss the lens completely. FIG. 5 illustrates rays (solid line) striking the aperture lens 80 and the intermediate corrective lens 70 at broadside ($\phi_1=\phi_2=0$), rays (dashed lines) at an intermediate scan angle ($f\sin\phi_1=F\sin_2$) and rays (dotted lines) at the maximum scan angle ($\phi_1=\lambda 2$, $\phi_2=\sin^{-1}f/F$).

From Eq. 7, the maximum scan angle is determined by the relationship $\sin\phi_2=f/F$. The usable range of the ratio F/D also is established from the maximum scan case. A short F/D is desirable to minimize the radius of the bootlace lens 80. On the other hand, the illuminated portion of the corrective lens 70 on receive must not overlap the feed array 65. From FIG. 5, this requires the angle F/D to satisfy the relation $(\pi/2-\phi_2)+D/F<\pi$ or $$\frac{D}{F} < \pi/2 + (\phi_2)_{max} \tag{8}$$

The equal-arc bootlace lens just described produces constant amplitude and linear delay and accordingly, maximum gain. "Microwave Antenna Theory and Design," edited by Samuel Silver, McGraw-Hill Book Company, 1949, Section 6-4. However, for some applications it may be economically advantageous to use an Abbé lens for which $$y = F\sin\frac{s_1}{f} \tag{9}$$

With the Abbé lens, a feed array 65 distribution having non-linear phase as a function of $s_1$ is required to produce a linear delay at the aperture 82. Since $\psi_2(y)=\psi_1(S)$ and $\psi_1(y)=(ky)\sin\psi_2$ to scan the beam to angle $\psi_2$, then from Eq. 9 the applied phase distribution on the feed array 65 must be $$\psi_1(s_1)=(kF)(\sin s_1/f)(\sin\psi_2) \tag{10}$$

Also from Eqs. 1 and 9, the amplitude distributions are related by $$A_2(y) = A_1\left(f\sin^{-1}\frac{y}{F}\right)*\left(\frac{f}{F}\right)^{\frac{1}{2}}/\left(1-\frac{y^2}{F^2}\right)^{\frac{1}{4}} \tag{11}$$

Therefore, a constant feed amplitude distribution with the Abbé lens produces a dip in amplitude at the center of the array. In the three dimensional version of the invention, an Abbé lens may be easier to construct, especially if waveguide lengths are employed to fabricate the transmission lines 83.

The perfect performance predicted from geometric optics is obtained because the corrective lens 70 images a circle onto another circle, or there is a continuum of focal pairs which fix the aperture distribution to be a scaled replica of the feed distribution. In the case where the radius F is infinite, it is well known that a conventional Luneberg lens with the dielectric constant n(r) which varies as a function of the radius r in accordance with the relationship $2-r^2/f^2$ performs the required function for the intermediate lens 70. However, R. K. Luneberg solved the problem in general for mapping a circle of radius $r_1$ onto another circle of radius $r_2$ for all $r_1$ and $r_2$. R. K. Luneberg, "Mathematical Theory of Optics," Brown University Press, Providence, R.I., 1944. Luneberg considered a spherically symmetric lens of unit radius which images a point source at radial distance $r_0$ to a second point at $r_1$, and used ray theory to derive an implicit expression for the refractive index n(r) of the lens in terms of the parameter $\rho(r)=rn(r)$ $$n=e^{\omega(\rho,r0)+\omega(\rho,r1)} \tag{12}$$

The function $\omega$ is the definite integral $$\omega(\rho,r_m)=\frac{1}{\pi}\int_{\rho}^{1}\frac{\sin^{-1}(\tau/r_m)d\tau}{(\tau^2-p^2)^{\frac{1}{2}}} \tag{13}$$

$m = 0$ or 1

In the case of interest here, r is the radius of the lens normalized to unity at a radius f, and $r_1$ is F/f. The function $\omega$ simplifies when $r^m=1$, $$\omega(\rho,1)=\tfrac{1}{2}n[1+(1-\rho^2)^{\frac{1}{2}}]; \tag{14}$$

otherwise $\omega$ is evaluated numerically.

Equations 12–14 may be used to determine n(r), specifying the Luneberg lens for a particular application, i.e., for particular values of f and F.

The most difficult case for construction of the intermediate lens 70 would be Maxwell's fish-eye where F=f, in which case the maximum dielectric constant is 4 at the center and is $4/(1+r^2/f^2)^2$ elsewhere. Luneberg lenses are commercially available and bootlace lenses are well known to microwave engineers.

Most optical limited scan schemes can be shown by geometrical optics to be inefficient due to poor aperture illumination, whereas the invention can be employed to provide an antenna system which is 100% efficient in the optical limit. To address remaining losses and to estimate the minimum number of discrete feed array elements, some simple diffraction concepts are invoked. It is well known that a continuous source and a uniform array of elements will produce essentially the same field provided the array elements are one-half wavelength spaced sample points of the continuous source and the radius of curvature of the surface is large compared to a wavelength. It is also known that the focus is not a geometric point but is the peak of a focal spot whose characteristic size is proportional to the wavelength of interest. A single array feed element with a symmetrical pattern will produce a symmetrical spot of finite size in the aperture centered on the geometric focus. Thus, a feed element placed such that its image is centered at the aperture edge will result in half of its power being lost to spillover. To avoid this loss, these feed elements are deleted. The remaining diffraction loss then is due to minor amplitude and phase ripples in the aperture distribution. Referring to FIG. 3, M feed elements (comprising feed array 60) spaced at $\lambda/2$ occupy the feed angle $M\lambda/2f=D/F$.

From Eq. 6, the maximum scan angle is $\sin^{-1}(f/F)$, so the angular coverage is $$\Delta\phi=2\sin^{-1}f/F=2\sin^{-1}(M\lambda/2D)=M\lambda/D \tag{15}$$

Since the far field beamwidth of a 100% efficient aperture D is $\lambda/D$, Eq. 15 recovers the well-known result that the minimum number of active elements in a limited scan array equals the number of beamwidths of angular coverage. The present invention provides antennas which are optimum in this regard and the number of active elements saved compared to an array of wavelength-spaced active elements at the aperture is 2f/F ($4f^2/F^2$ in three dimensions).

Implementation of the invention can be divided into the two-dimensional and the three-dimensional cases. In two dimensions, the equal arc length bootlace aperture lens is easily constructed, and the corrective lens may be realized in at least two ways. The variable dielectric approach is one way, wherein the lens is a flat lens of dielectric material whose dielectric constant varies as a function of radial distance from the center as described above. Another way is to implement the lens as a parallel plate geodesic dome whose shape is determined starting with Fermat's formula. This implementation closely parallels a case detailed in the literature for a special purpose dome. E. C. Dufort and H. Uyeda, "A Wide Angle Scanning Optical Antenna," IEEE Trans. GAP AP-31, January 1983, page 60, et seq. These domes may be produced using metal spinning techniques.

Figure 6:
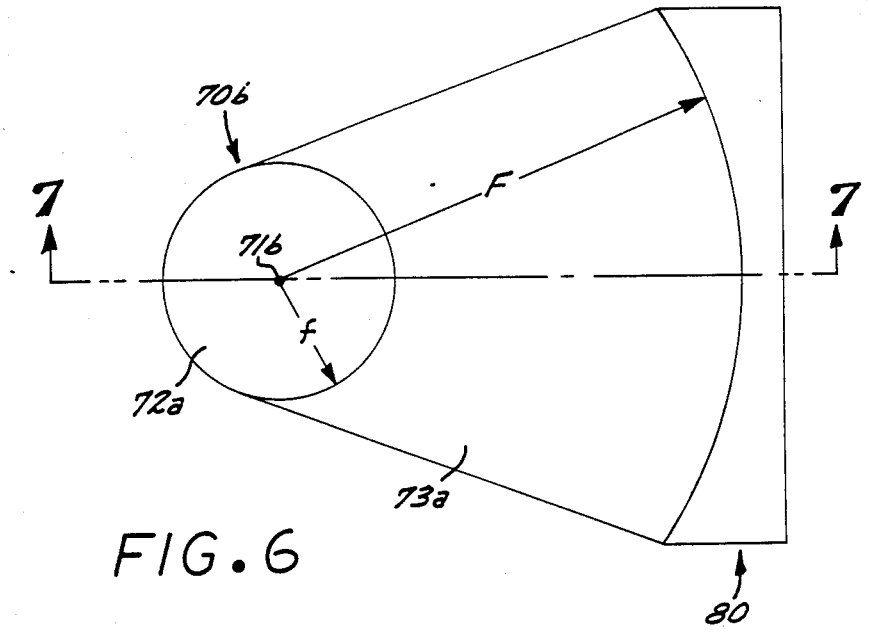
FIG. 6 is a top schematic view illustrating an embodiment of the corrective lens as a parallel plate geodesic dome.
Figure 7:
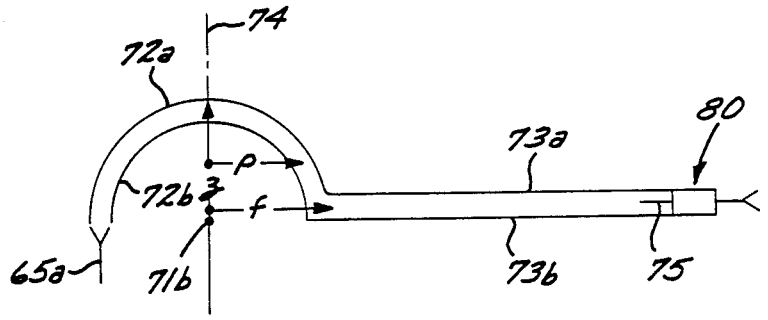
FIG. 7 is a cross-sectional view of the embodiment of claim 6 taken through line 7—7.

FIGS. 6 and 7 illustrate the two dimensional case of a parallel plate dome serving as the corrective lens in the system 50 generally depicted in FIG. 3. FIG. 6 is a top view showing the top surface of the dome **70*b*, which is connected to the bootlace lens 80 by a flat parallel plate structure. The structure of this embodiment is more clearly illustrated in the cross-sectional view of FIG. 7. The dome is constructed of two concave, parallel metal plates 72*a* and 72*b*. Along the feed edge of the dome, the array of feed elements 65*a* are arranged as described above with reference to FIG. 1. At the aperture side of the dome, the upper and lower dome plates 72*a* and 72*b* are respectively joined to flat metal plates 73*a* and 73*b*. This flat parallel plate structure couples the dome 70*b* to the bootlace lines 80. The pickup elements or probes 75 are disposed along the peripheral edge of the image arc, as described above with respect to FIG. 3**.

The curvature of the parallel plates comprising the dome **70*b* is determined in the following manner. Let f indicate the radius of the dome at its base, and F indicate the radial distance from the center point 71*b*. The radius $\rho$ of the dome measured from axis 74 at a particular height z above the center point 71*b*** are related by Equations 16 and 17.

$$z(\rho)=\int_{\rho}^{f}(s^2(u)-1)^{\frac{1}{2}}\,du \tag{16}$$

where s(u) is the function $$s(u)=\Big(f/(f^2-u^2)^{\frac{1}{2}}-\frac{1}{\pi}[f\cos^{-1}(f/F)/(f^2-u^2)^{\frac{1}{2}}- \tag{17}$$

-continued $$\cos^{-1}((f^2 - u^2)^{\frac{1}{2}}/(F^2 - u^2)^{\frac{1}{2}}]$$

The integral in Equation 16 usually must be evaluated numerically except in the case F equals infinity, which is known as Rinehart's dome, and the case where F equals f (Maxwell's fish-eye). In the latter case, the dome is a hemisphere and the rays are great circles.

In three dimensions, the aperture lens is most easily constructed with waveguide transmission lines connecting the respective pick-up and radiating elements to form an Abbé lens. As described above, the subarrays will be different, and the amplitude distribution will be inversely tapered; however, the phase can be corrected and the gain should not suffer. Insofar as is presently known, the correction lens must be constructed as the dielectric Luneberg lens in three dimensions, as there is no known three-dimensional analog to the parallel plate geodesic dome in the two-dimensional case.

With respect to the feed array 65, the array should be matched for plane waves at all possible angles of incidence, as is well known to those skilled in the art. For the three-dimensional case, the feed array could advantageously comprise waveguide sections terminated in probes at the surface of the corrective lens 70.

The pick-up elements and radiating elements comprising the aperture lens should be matched to a plane wave over the possible angles of incidence. This matching is relatively easier to achieve than for the feed array 65, since the range of angles for the aperture lens is not as great as for the corrective lens.

To practice the invention, one need not employ a feed-through bootlace lens 80. For example, for the line source case the bootlace lens may be replaced by a folded pillbox antenna. Pillbox antennas are well known in the art, being described, for example, in U.S. Pat. No. 2,688,546 to L. J. Chu and M. A. Taggart. The folded pillbox antenna may be constructed out of sheet metal, and when the fold is properly oriented with respect to the corrective lens 70, the performance of the system is almost as good as the system employing the bootlace lens, achieved with a simplification in the system. When the corrective lens is constructed in parallel plates in the form of a properly shaped dome as described above, both the corrective lens 70 and lens 80 may be constructed of sheet metal which is relatively simple and inexpensive to fabricate.

Figure 8:
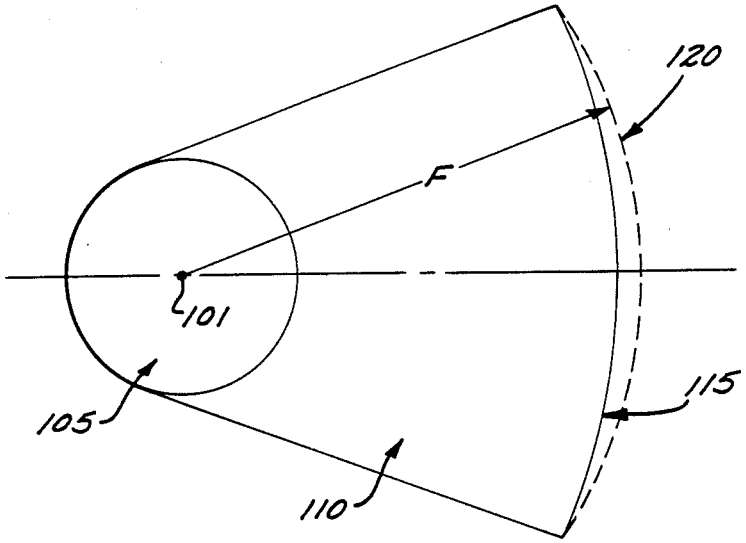
FIG. 8 is a top schematic view of an embodiment employing a folded pillbox antenna as the aperture lens.

An embodiment of the invention which employs a pillbox antenna instead of a bootlace lens is shown in FIG. 8. This embodiment is for the two-dimensional case, and the corrective lens 105 may be implemented as a flat disc member whose dielectric constant varies with radius, as described hereinabove. Alternatively, the lens 105 may comprise a properly shaped, parallel-plate dome as described above with respect to FIGS. 6 and 7. A parallel plate structure 110 optically couples the lens or dome 105 to parabolic reflector 115.

The reflector 115 is adapted to reflect energy incident from the lens or dome 105 into a flared horn aperture extending beneath the structure 110. In the embodiment disclosed in FIG. 8, the parabolic reflector passes through the image arc 120 (of radius F) at the aperture edges; the focus of the parabolic reflector 115 is located at the center 101 of the lens or dome 105. The distribution on the image arc will be a stretched version of the source distribution, disregarding diffraction effects. Since the parabola 115 intersects the focal arc 120 at the aperture edges, the distribution on the parabola is constrained at these points so that there is no spillover loss. The aperture distribution will distort slightly as the beam is scanned off broadside; this is the small penalty paid for using the reflector structure.

Figure 9:
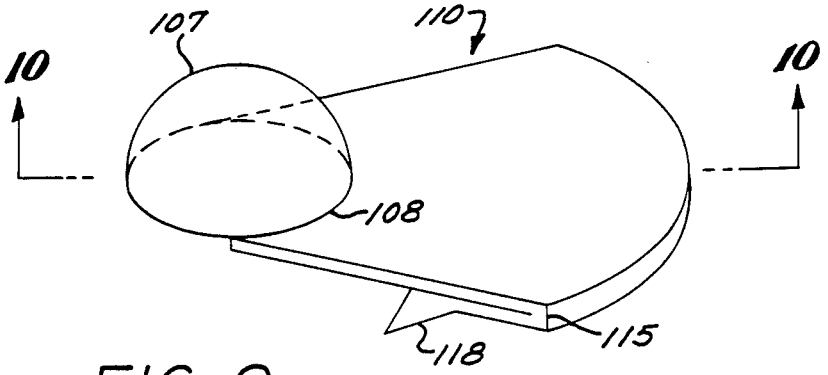
FIG. 9 is an oblique view of an embodiment employing a parallel plate geodesic dome as the corrective lens and a folded pillbox antenna as the aperture lens.
Figure 10:
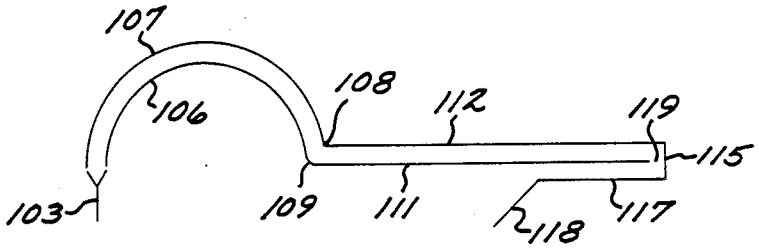
FIG. 10 is a cross-section view of the structure of FIG. 9 taken through line 10—10 of FIG. 9.

FIGS. 9 and 10 illustrate the system shown in FIG. 8 for the case wherein the corrective lens 105 is a parallel plate dome structure. FIG. 9 is an oblique view of the structure, and FIG. 10 is a cross-sectional view taken through line 10—10 of FIG. 9. The dome 107 comprises concave parallel plates 106 and 107, whose contours are selected in accordance with Eqs. 16 and 17. Upper curved plated 107 joins with upper flat plate 112 of structure 110 along curved line 108. Lower curved plate 106 joins with lower flat plate 111 of structure 110 along curved line 109.

The feed array for the structure illustrated in FIGS. 9 and 10 comprises a plurality of feed horns 103 adapted to launch or collect energy within the space defined between the parallel plates 106 and 107.

The upper flat plate 112 is terminated with the parabolic reflector surface 115, which is joined to the upper plated 112 at a right angle thereto. Flat plate 117 is joined to the opposing end of the reflector surface 115 at a right angle thereto so that plate 117 extends parallel to flat plates 111 and 112. Flared surface 118 is joined to flat plate 117 to define a flared horn aperture of the pillbox antenna structure.

As is known to those skilled in the art, the gap 119 between the edge of the flat plate 111 and reflector surface 115 may be selected such that substantially all of the energy propagating between flat plates 111 and 112 and incident upon surface 115 will be reflected into the region between plates 111 and 117 and then to the flared horn aperture defined by flared surface 118 and plate 111.

That the reflector should be parabolically shaped is evident by considering reflections from a point source at the edge of the feed array. A point source on the feed array arc is focused to a point on the image arc. The central ray of the illumination from the point source is reflected parallel to the axis of symmetry by the parabola such that the reflected pattern is shaped in the desired direction. There is a slight rotation of the edge rays from each point source which is another small penalty paid for using the parabolic reflector. The rotation can be corrected by reshaping the reflector slightly.

Figure 11:
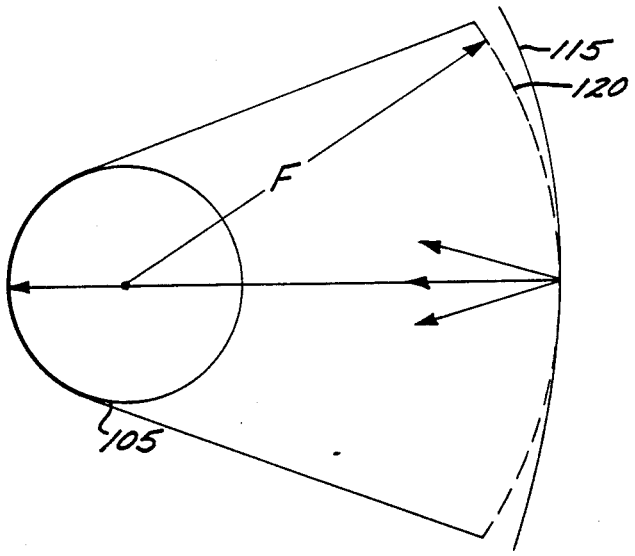
FIG. 11 is a simplified schematic and ray diagram illustrative of an embodiment employing a folded pillbox antenna having an enlarged reflector radius.

It may be advantageous for systems with highly tapered illuminations (used for low sidelobe radiation patterns) to increase the focal length of the parabolic surface such that it is tangent to the image arc at the axis of symmetry as shown in FIG. 11. This results in a zero distortion distribution near the tangent point.

The optical limited scan antenna system 0 of the invention operates in the following manner. An input rf signal is provided at the input port 56 of the power divider 55, which may comprise a corporate feed network such as is well known in the art. The power divider operates to distribute the input rf energy among the various output terminals 57 of the divider 55 so as to provide the desired amplitude distribution a the corrective lens 70. The respective output terminals 57 are coupled to the corresponding feed elements **65*a* comprising the feed array 65 by respective phase shifters 60. These phase shifters 60 are controlled by the phase shift controller 62 in a manner to achieve the desired phase distribution at the corrective lens 70**. For example, the desired feed distributions may be the constant amplitude distribution and the constant or linear phase distribution described above to maximize the aperture gain.

The rf energy from the feed array passes through the corrective lens 70 in the manner described above, with the angle $\phi_1$ determined by the controller 62, and is intercepted by the pick-up elements 75 of the aperture lens 80. The feed distribution is mapped into the radiating elements 85 of the linear aperture 82, thereby launching a beam of rf energy which leaves the linear aperture at the angle $\phi_2$ which is determined by $\phi_1$, F and D, as described above.

While the operation of the preferred embodiment has been described in terms of the transmit mode, it will be understood by those skilled in the art that the operation is reciprocal, and the invention may be used to receive or to transmit a beam over a limited scan.

It is understood that the above-described embodiment is merely illustrative of the possible specific embodiments which can represent principles of the present invention. Other arrangements may be devised in accordance with these principles by those skilled in the art without departing from the scope of the invention.

What is claimed is:

1. A high efficiency, limited scan optical antenna system, comprising:

an aperture lens having a circular inner surface with a finite radius and a linear aperture, said aperture lens comprising a plurality of radiating elements disposed along said linear array and a corresponding plurality of pickup elements disposed along said inner surface, corresponding ones of said radiation and pickup elements being coupled together by equal lengths of transmission lines;

an rf feed system comprising a plurality of feed elements, said system comprising means for providing a source distribution of rf radiation; and a symmetric optical corrective lens centered at the center of said inner surface, said corrective lens comprising means for imaging the radiation at each feed element to a corresponding image point on said inner surface of said aperture lens so as to map the source distribution of said feed elements onto said inner surface to form an aperture distribution which is a scaled version of said source distribution.

2. The system of claim 1 wherein said corrective lens comprises a circularly symmetric lens whose dielectric constant varies as a function of the radius.

3. The system of claim 1 wherein said corrective lens comprises a Luneberg lens.

4. The system of claim 1 wherein said corrective lens comprises a parallel plate geodesic dome structure.

5. The system of claim 1 wherein said aperture lens comprises a bootlace lens.

6. The system of claim 1 wherein said means for providing a source distribution of rf radiation comprises:

a power divider means having an input port and a plurality of output ports, said means for distributing the rf power of an input rf signal at said input port among said output ports;

a plurality of phase shifters coupled to said output ports of said power divider;

a feed array comprising a plurality of feed elements, said array coupled to said output ports by said phase shifters, said feed elements disposed adjacent said surface of the corrective lens to illuminate said corrective lens.

7. The system of claim 6 wherein said for providing a source distribution of rf radiation comprises a phase shifter controller for controlling the respective phase shift introduced by the respective phase shifter elements to steer the beam formed by said aperture distribution over a limited scan beam coverage.

8. The system of claim 6 wherein said feed elements are spaced apart by a distance equivalent to one-half of the wavelength of interest.

9. The system of claim 8 wherein said feed array comprises M elements, said inner surface has a radius of curvature F, said linear aperture has a length D, and wherein the minimum number M of feed elements is determined by the maximum scan angle $\Delta\phi$ of the system by the relationship $$\Delta\phi = M\lambda/D$$

where $\lambda$ represents the wavelength of interest.

10. The system of claim 1 wherein said means for providing a source distribution of rf radiation, said aperture lens and said corrective lens are adapted to provide an aperture distribution having constant amplitude and linear phase so as to maximize the aperture efficiency of the system.

11. The system of claim 10 wherein said means for providing a source distribution of rf radiation is adapted to provide a source distribution having constant amplitude and constant phase, and wherein said aperture lens comprises a bootlace lens wherein the corresponding radiating element is spaced from the aperture center by a distance equal to the arc length distance of the corresponding pickup element from the central surface point of the inner surface of the aperture lens.

12. The system of claim 10 wherein said aperture lens comprises an Abbé lens.

13. A high efficiency, limited scan optical antenna system, comprising:

an aperture lens having a circular inner surface and a linear aperture;

a plurality of radiating elements disposed along said linear aperture; and a plurality of corresponding pick-up elements disposed along said circular inner surface, corresponding ones of said radiating elements and said pick-up elements being coupled together by equal lengths of transmission lines;

a feed network comprising a plurality of feed elements for providing a source distribution of rf energy;

a circularly symmetric optical corrective lens centered at the center of said circular inner surface of said aperture lens, said feed elements being disposed adjacent the surface of said corrective lens to illuminate said surface with said source distribution, said corrective lens comprising means for imaging each point source of radiation at the surface of the corrective lens to a corresponding image point on the inner surface of the aperture lens so as to map the source distribution onto said circular inner surface of said aperture lens to form an aperture distribution at said linear aperture which is a scaled version of said source distribution.

14. A high efficiency, limited scan antenna system, comprising:

a bootlace-type aperture means, comprising a concave inner surface and a linear aperture, a plurality of equally spaced radiating elements disposed along said linear aperture, a plurality of equally spaced pickup elements disposed along said inner surface, and a plurality of transmission lines of equal length connecting respective ones of said pickup elements to a corresponding one of said radiating elements, said respective corresponding radiating element being spaced from the center of the linear aperture by a distance equal to the arc length distance from the corresponding pickup element to a central surface point on said inner surface;

a circularly symmetric intermediate lens having a radially varying dielectric constant, said lens disposed at the focal point of said inner surface and adapted such that each radiation source point on is surface is focused at a corresponding image point on said inner surface of said aperture lens;

a power divider having an input port and a plurality N of output ports;

a feed array comprising N feed elements for illuminating the corrective lens with an input distribution;

a plurality N of phase shifters for respectively coupling respective output port to a corresponding feed element;

said power divider and phase shifters adapted to provide a source distribution having a constant amplitude and constant phase; and phase shifter controller for controlling the amount of phase shift introduced by the respective phase shifters so as to position the beam produced by said system over a limited angular scan from broadside.

15. A limited scan antenna system, comprising:

means for providing a substantially two dimensional source distribution of electromagnetic energy, said means comprising a plurality of feed elements disposed along a source arc of radius f;

a circularly symmetric corrective lens having a radius substantially equal to the radius f of said source arc for transforming said source distribution into a corresponding image distribution along an image arc at a radius F from the center of the corrective lens, said lens at a corresponding image point on said image arc;

means for transforming said image distribution into a substantially linear aperture distribution; and means for scanning said source distributed over a limited angular scan about the broadside condition.

16. The antenna system of claim 15 wherein said corrective lens comprises a parallel-plate geodesic dome structure comprising a pair of conductive plates.

17. The antenna system of claim 16 wherein said transforming means for transforming said image distribution into a substantially linear aperture distribution comprises a bootlace lens, comprising an inner surface extending along said image arc and a plurality of pickup elements disposed along said inner surface, and further comprising a pair of conductive flat plates extending between respective ones of the plates of the dome structure and said inner surface of said bootlace lens to conduct electromagnetic energy between said dome structure and said pickup elements disposed along said inner surface of said bootlace lens.

18. The antenna system of claim 15 wherein said transforming means for transforming said image distribution into a substantially linear aperture distribution comprises a folded pillbox antenna structure having a parabolic reflecting surface disposed near the image arc.

19. The antenna system of claim 18 wherein said corrective lens comprises a parallel-plate geodesic dome structure coupled to said folded pillbox antenna structure by a pair of conductive plates.

20. The antenna system of claim 19 wherein said parabolic reflecting surface of said folded pillbox antenna is arranged to intersect said image arc at the aperture edges.

21. The antenna system of claim 19 wherein said parabolic reflecting surface of said folded pillbox antenna is arranged to intersect said image arc at the center of the aperture.

* * * * *